US006209251B1

(12) United States Patent
Avganim

(10) Patent No.: US 6,209,251 B1
(45) Date of Patent: Apr. 3, 2001

(54) FIREARM SAFEGUARD DEVICE

(76) Inventor: Meir Avganim, 156 Moshav, 76885 Gealiya (IL)

( * ) Notice: Subject to any disclaimer, the term of this patent is extended or adjusted under 35 U.S.C. 154(b) by 0 days.

(21) Appl. No.: 09/331,888

(22) PCT Filed: Feb. 4, 1998

(86) PCT No.: PCT/IL98/00053

§ 371 Date: May 18, 1999

§ 102(e) Date: May 18, 1999

(87) PCT Pub. No.: WO98/35201

PCT Pub. Date: Aug. 13, 1998

(30) Foreign Application Priority Data

Feb. 5, 1997 (IL) ..... 120153

(51) Int. Cl.[7] ..... F41A 17/54
(52) U.S. Cl. ..... 42/70.07
(58) Field of Search ..... 42/70.07, 70.11

(56) References Cited

U.S. PATENT DOCUMENTS

| | | | | |
|---|---|---|---|---|
| 2,195,693 | | 4/1940 | Clifton . | |
| 2,948,978 | | 8/1960 | Salverda . | |
| 3,020,663 | | 2/1962 | Newson . | |
| 3,392,471 | | 7/1968 | Foote . | |
| 5,392,551 | | 2/1995 | Simpson . | |
| 5,487,234 | * | 1/1996 | Dragon | 42/70.07 |
| 5,638,627 | * | 6/1997 | Klein et al. | 42/70.07 |
| 5,647,158 | * | 7/1997 | Eskelinen | 42/70.07 |
| 5,704,152 | * | 1/1998 | Harrison et al. | 42/70.07 |

* cited by examiner

*Primary Examiner*—Michael J. Carone
*Assistant Examiner*—Troy Chambers
(74) *Attorney, Agent, or Firm*—Ostrolenk, Faber, Gerb & Soffen, LLP

(57) ABSTRACT

A firearm safeguard device, comprises first (22) and second (10) trigger-guard, blocking members. The second member (10) is provided with a fixed, non-rotating ratchet spindle (20). The first member (22) includes a ratchet rider member (42), mounted by means of a coil compression spring (52), allowing both reciprocating and deflecting movements. Locking of the device is achieved by a push-in lock (60) arresting the member (42).

6 Claims, 2 Drawing Sheets

FIREARM SAFEGUARD DEVICE

BACKGROUND OF THE INVENTION

The present invention relates to firearm safety devices of the kind designed to prevent unauthorized access to the trigger by blocking the trigger guard.

Known devices of this type (cf. U.S. Pat. No. 5,535,537, of the present Applicant) comprise a pair of blocking members adapted to be locked to each other around the trigger guard. According to the conventional design one of the blocking members is provided with a selectively rotatable spindle with a series of ratchet teeth thereon. The spindle is receivable within a cavity formed at the other blocking member, which is provided with ratchet rider member. In the operative, locking position the ratchet teeth are meshed, and the separation of the members from each other is thus prevented. In order to release the members, the ratchet teeth spindle must be rotated to disengage the ratchet teeth from the ratchet rider and allow the sliding out of the spindle.

The rotation of the spindle from the engaging to the disengaging position is achieved by a key operated mechanism of various types and designs.

These devices however suffer certain disadvantages. First, the ratchet rider must be spring-urged, and for that purpose the spring must be rather strong to avoid the release of the members by a sharp shock against the device. This, however, entails excessive wear of the ratchet teeth.

Secondly, the manipulation of the spindle by a key for the unlocking of the device is cumbersome and time consuming which is considered specifically disadvantageous when time is of essence, namely when one must reach for the weapon and bring it as quickly as possible to an operative shooting position.

The present invention provides a modified design of the locking mechanism of trigger guard blocking devices, being more simple, compact and easy to manipulate.

Further, the present invention improves the safety of the device against forceful tampering therewith.

Still further, the invention facilitates the operation of the device by electric or remote controlled means.

SUMMARY OF THE INVENTION

Thus provided according to the present invention is a firearm safety device for a firearm including a trigger and a trigger guard over the trigger. The device comprises first and second trigger blocking members adapted to engage and lock to each other around the trigger guard and prevent access to the trigger. The first blocking member comprises a hollow configured to receive a projecting, ratchet-toothed fixed spindle of the second blocking member. A ratchet rider member is installed having a ratchet toothed surface, so that reciprocating movement of the rider towards and away from the hollow is allowed. A spring is provided for urging the ratchet-toothed surface against the ratchet-toothed spindle when inserted into the hollow. The ratchet rider member is further provided with pivot means allowing a rotational movement thereof into a position wherein the toothed surface thereof disengages the ratchet teeth of the spindle. Selectively operable means are provided for immobilizing the movement(s) of the rider member.

The second blocking member comprises a non-rotatable ratchet spindle.

Preferably, the rider member immobilizing means comprise a key-operated push-in lock cooperating with a recess formed in the rider member.

BRIEF DESCRIPTION OF THE DRAWINGS

These and additional constructional features and advantages of the invention will become more clearly appreciated in the light of the ensuing description of preferred embodiments thereof, given by way of example only with reference to the accompanying drawings, wherein.

DETAILED DESCRIPTION OF THE PREFERRED EMBODIMENT

Figure 1B:
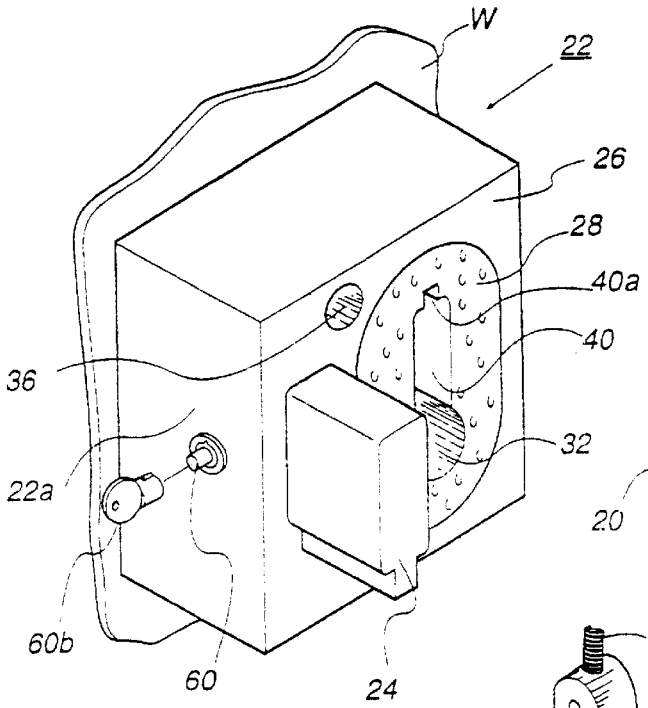
FIG. 1*b* is a schematic three dimensional view of the second, mating blocking member.
Figure 1A:
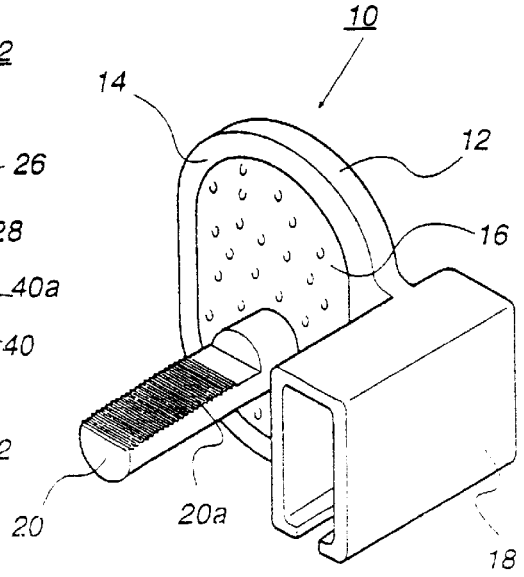
FIG. 1*a* is a schematic three dimensional view of one blocking member.
Figure 1C:
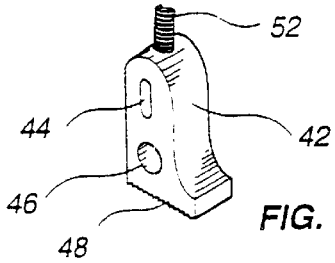
FIG. 1*c* shows the rider member which is assembled within the second blocking member.
Figure 2:
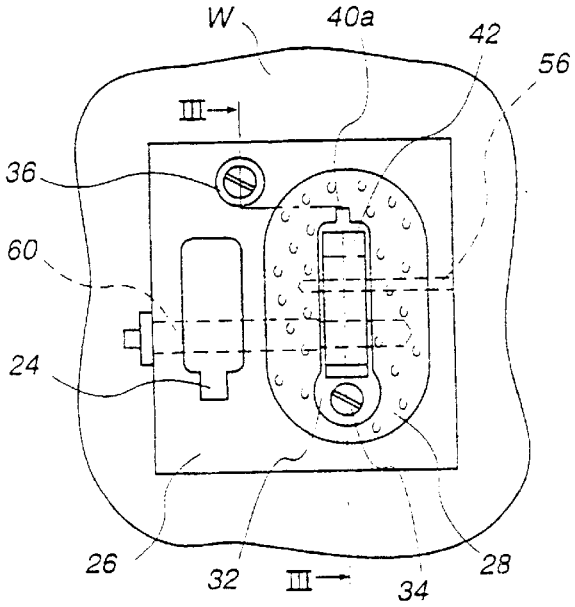
FIG. 2 is an elevation of the second blocking member.

First blocking member denoted 10 is generally similar to the corresponding member of the traditional design, except for an important and unique feature that its ratchet spindle is not rotatable but rather made integral with the remaining structure. Hence, the member 10 comprises a trigger-guard blocking plate 12 presenting a flat surface 14 which is preferably provided with a rubber pad 16, as customarily known, and so is guide channel 18. Ratchet spindle 20 is cylindrical, with ratchet teeth 20*a* extending along a planar surface which is cut-away from the cylindrical spindle 20.

Since the member 10 has no moving parts it can readily be made by casting or press-forming (sintering) with no need for any additional processing or finishing operations.

The other, mating member 22 is shown to be in the form of a block 22*a* mounted to a wall W, however this is not necessarily so and is illustrated to amplify the significant advantage of the design according to the invention. The member 22 comprises the counterpart, male portion 24 which slidingly fits into the cavity of the guide channel 18, and a flat surface 26 with rubber pad 28.

Figure 3:
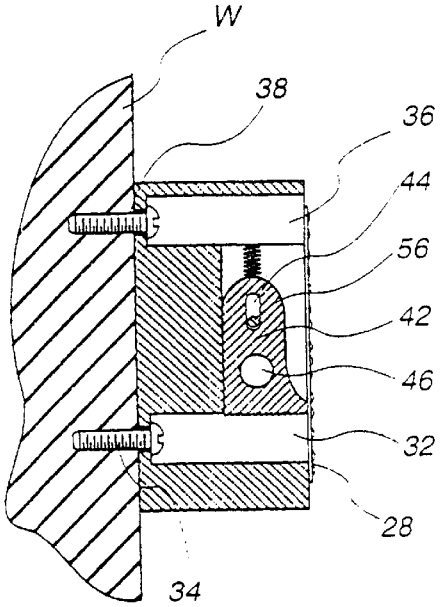
FIG. 3 is a section taken along line III—III of FIG. 2.

The block 22*a* is formed with a cylindrical hollow cavity 32 of a diameter slightly larger than the spindle 20 for the sliding insertion of the latter in the locking position of the members. The cavity 32 is used in the present embodiment also for receiving one wall mounting screw 34. A second bore 36 is made for mounting the block by screw 38 (see FIG. 3).

Freely seated within a slot 40 is a ratchet rider member denoted 42. The rider member 42, which is generally boot-shaped, comprises a slot 44, a bore 46, and its tread or base surface is formed with ratchet teeth 48, engageable with ratchet teeth 20*a* of the spindle 20. The member 42 is coupled by a pivot pin 56, enabling a limited reciprocating movement, and is further urged downwards by a compression coil spring 52. The spring 52 is pressed at one end into a receiving bore 54 (see FIG. 4*a*), whereas its other end is clamped within extension recess 40*a*. The spring 52 thus functions both as means for urging the rider member 42 downwards, and for allowing its small angle deflection about pivot pin 56. As more clearly seen in FIGS. 4 and 5, a standard push-in lock 60 is accommodated within a suitable bore extending in a direction perpendicular to the pivoting plane of the rider 40 and so located that its locking detent 60*a* is adapted, in the locking position of the device, to become inserted into the bore 46. Therefore the immobilization of the rider member 42 is simply accomplished by pushing the operative button of the lock 60, while its release is effected by use of a key 60*b* (FIG. 1*b*).

The locking and unlocking process will now be described with particular reference to FIGS. 4*a*–4*c*. When the spindle 20 is pushed into the hollow 32, the ratchet rider is in its inner position (shown in FIG. 4*a*) and is elastically pressed against the spindle 20 which therefore will freely click its way to the desired depth. The locking or immobilization of the rider 42 will be effected by pushing home the button 60*a* of the push-in lock 60. The locking is thus safeguarded without any further manipulation.

Figure 4A:
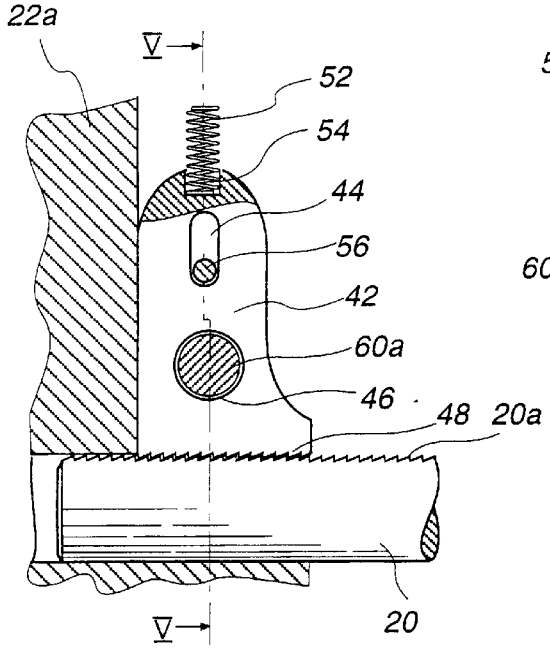
FIG. 4*a* shows, on an enlarged scale, the operative components of the blocking members in a locking engagement position.
Figure 4B:
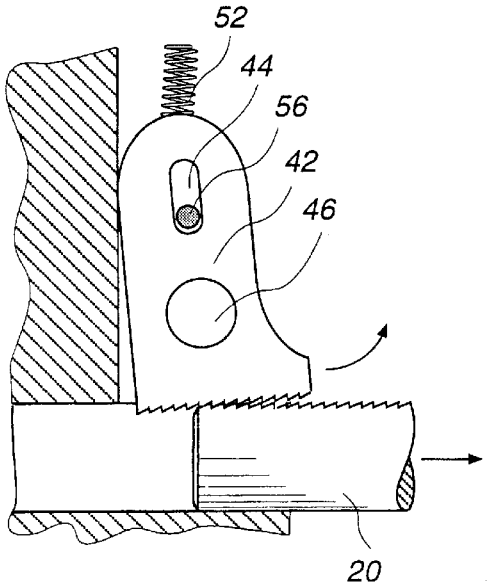
FIG. 4*b* shows the components of FIG. 4*a* in the releasing position.

The releasing of the members from each other is illustrated in FIG. 4*b*, where extraction of the spindle 20 (after unlocking the lock 60) will cause the deflection of the rider member 42, thus the disengagement of the ratchet teeth coupling, as shown.

Figure 5:
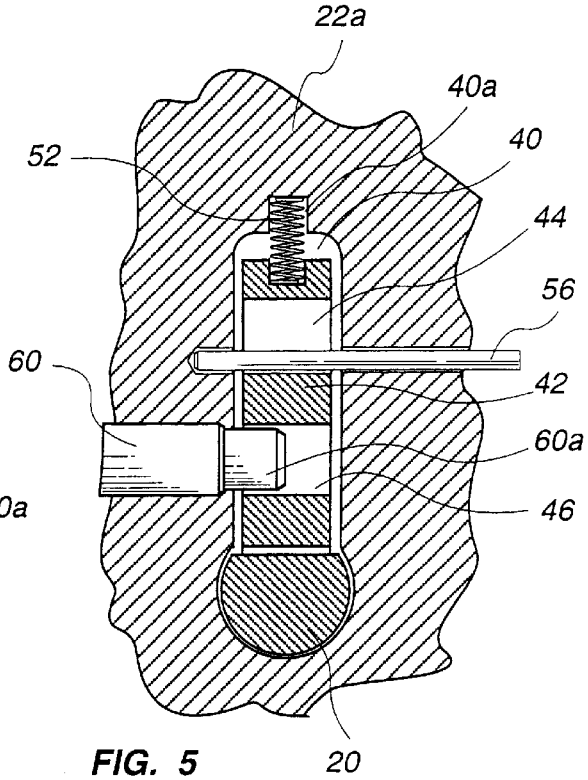
FIG. 5 is a partial cross-sectional view taken along line V—V of FIG. 4*a*.
Figure 4C:
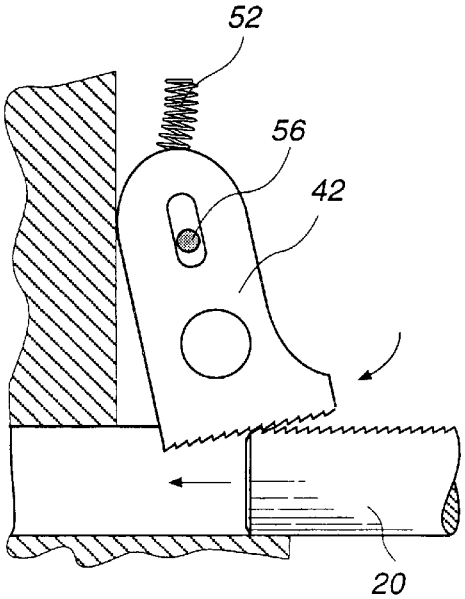
FIG. 4*c* shows the components of FIG. 4*a* in an intermediate, pre-locking position.

In the non-operative position of FIG. 4*c* it is shown that due to the bending effect of the coil spring 52 the rider member is attracted into an intermediate position wherein the insertion of the spindle 20 will first bring it into the position of FIG. 4*a* and then the ratchet effect will take place as already described.

It will be now readily appreciated that the reliability of the device significantly increases, since the amount of resistance against the retrieval of the spindle from the ratchet coupling state no longer depends on the elasticity of the spring urging the ratchet rider member against the spindle as in the conventional devices; in fact, a significantly weaker spring can be used. Furthermore, the unlocking is more simply effected and no longer involves a rotational movement of the spindle.

In addition, more versatile operation modes are made possible in a simple manner, e.g. the electrically or otherwise remotely controlled unlocking, as described in the above mentioned U.S. Pat. No. 5,535,537, which are self-explanatory and need not be described in greater detail.

Those skilled in the art will readily understand that various changes, modifications and variations may be applied to the invention as above exemplified without departing from the scope of the invention as defined in and by the appended claims.

What is claimed is:

1. A firearm safety device for a firearm including a trigger and a trigger guard over the trigger, the device comprising first and second trigger blocking members adapted to engage and lock to each other around the trigger guard and prevent access to the trigger, the first blocking member being formed with a passage and the second blocking member being provided with a spindle formed with a rack of ratchet teeth and fitting into the passage, the first blocking member comprising:

(i) a ratchet rider member having a ratchet toothed surface complementary to the ratchet-teeth of the spindle;

(ii) means for coupling the rider member comprising:

(a) a compression coil spring mounted on one end to the rider member at a side opposite to the ratchet-toothed surface, the coil spring being anchored at an opposite end for urging the ratchet member against the ratchet-toothed spindle when the spindle is inserted into the passage; and (b) pin-and-slot means configured to guide both a reciprocating movement of the rider member in a direction normal to the axis of the spindle and a rotational movement of the rider member about the pin of the pin-and-slot means; and (iii) immobilizing means for selectively securing the rider member in a ratchet teeth engaging position with the spindle.

2. The device of claim 1 wherein the spindle is generally cylindrical, a planar surface being formed thereon provided with a rack of saw-shaped teeth.

3. The device of claim 2 wherein the spindle is integrally formed with the second blocking member.

4. The device of claim 3 wherein the rider member is formed with a recess, said immobilizing means comprising a key operated push-in lock, whose lock detect is adapted to penetrate into said recess.

5. The device of claim 4 wherein the rider member is of a generally boot-like shape formed with a flat ratchet-toothed surface, and is slidable within a first slot formed in the first blocking member.

6. The device of claim 1, wherein the pin-and-slot means is configured such that extraction of the spindle from the passage upon release of the rider member from the immobilizing means causes a deflection of the rider member into a position in which the toothed surface of the rider disengages the ratchet teeth of the spindle.

* * * * *